US006923839B2

(12) United States Patent
Stickney et al.

(10) Patent No.: US 6,923,839 B2
(45) Date of Patent: Aug. 2, 2005

(54) FUEL BLEND FOR AN INTERNAL COMBUSTION ENGINE

(75) Inventors: Michael J. Stickney, Houston, TX (US); Edward M. Jones, Jr., Friendswood, TX (US); Mallasetty S. Chandrasekharaiah, deceased, late of Nassau Bay, TX (US); by Sudhir Kumar, legal representative, Forrest City, AR (US)

(73) Assignee: Cooper Cameron, Houston, TX (US)

( * ) Notice: Subject to any disclaimer, the term of this patent is extended or adjusted under 35 U.S.C. 154(b) by 179 days.

(21) Appl. No.: 09/891,902

(22) Filed: Jun. 26, 2001

(65) Prior Publication Data

US 2003/0051393 A1 Mar. 20, 2003

(51) Int. Cl.[7] ..... C10L 1/18
(52) U.S. Cl. ..... 44/388; 44/389; 44/393
(58) Field of Search ..... 44/388, 389, 393, 44/385

(56) References Cited

U.S. PATENT DOCUMENTS 1,423,048 A * 7/1922 Tunison
3,658,495 A * 4/1972 Dorer, Jr.
3,869,262 A * 3/1975 Mayerhoffer et al.
3,903,251 A * 9/1975 Sieg et al.
4,154,580 A * 5/1979 Landis
4,392,868 A * 7/1983 Teckmeyer et al.
4,394,133 A * 7/1983 Smith
4,405,336 A * 9/1983 Badger
4,405,337 A * 9/1983 Mori
4,806,129 A * 2/1989 Dorn et al.
5,232,464 A * 8/1993 Klezl ..... 44/388
5,302,592 A * 4/1994 Osei-Gyimah et al.
6,076,487 A * 6/2000 Wulff et al. ..... 44/401
6,287,351 B1 * 9/2001 Wulff et al. ..... 44/401

FOREIGN PATENT DOCUMENTS

DE DT2523992 A1 * 7/1976
WO WO95/02654 * 1/1995

* cited by examiner

*Primary Examiner*—Margaret B. Medley
(74) *Attorney, Agent, or Firm*—Peter Bielinski; Mike Hartmann

(57) ABSTRACT

A fuel blend for use in an internal combustion engine is provided. The fuel blend comprises a hydrocarbon-containing fuel component and an oxygen-containing component capable of providing a portion of the oxygen needed for combustion of the fuel component under conditions prevailing during the combustion cycle of the internal combustion engine. The major oxygen-providing agent of the oxygen-containing component is one or more compounds having the general formula (I) $R_2$—O—(CO)—$R_1$, wherein $R_1$ is selected from hydrogen, lower alkyl, lower alkenyl and lower alkynyl groups, $R_2$ is selected from lower alkyl, lower alkenyl and lower alkynyl groups, or a group having the general formula (II) $R_3$—(CO)—O—$R_4$—wherein $R_3$ is selected from lower alkyl, lower alkenyl and lower alkynyl groups, and $R_4$ is selected from lower alkyl. The blend may additionally comprise one or more of a stabilizer, a biocide and a substituted alcohol. Fuel additives comprising a combination of compounds having the general formula (I) are also provided. The additives may be used as oxygenating additives in the formulation of fuels, such as gasoline and diesel.

43 Claims, No Drawings

FUEL BLEND FOR AN INTERNAL COMBUSTION ENGINE

TECHNICAL FIELD OF THE INVENTION

The present invention relates to a fuel blend, in particular a fuel blend comprising a hydrocarbon fuel for use in operating an internal combustion engine. In a further aspect, the present invention relates to an additive composition for combining with a fuel, in particular a hydrocarbon fuel for an internal combustion engine.

BACKGROUND OF THE INVENTION

A range of hydrocarbon-based fuel compositions have been developed over the years for use in operating a wide range of internal combustion engines. Such fuels include both gasoline, used as the primary fuel for automotive vehicles, and diesel, used as the fuel for a wide range of trucks, trains, ships, and other automotive applications. For many years, the fuel compositions, while effective for providing the necessary power from the engines in which they were employed, suffered the disadvantage of producing a range of exhaust products that are both hazardous and environmentally unfriendly. In recent years, however, problems associated with the products from combusting hydrocarbon-containing fuels have been recognized and there has been a growing need for improved hydrocarbon-based fuel compositions, which meet the needs of the engines in which they are employed while producing an exhaust product which is less detrimental to the environment.

For example, gasoline was for many years blended with lead-containing compounds, most typically tetraethyl lead, in order to provide the fuel with the necessary octane rating and provide lubrication for certain components of gasoline-powered internal combustion engines. Following the recognition of the harmful effects on the environment of the lead-containing products present in the exhaust gases of engines burning lead-containing fuels, a range of unleaded gasoline compositions were developed and made available. Further, diesel fuel compositions have products of combustion having high concentrations of carbon, carbon monoxide and various oxides of nitrogen when combusted in an internal combustion engine.

With the significant recent interest in producing clean hydrocarbon fuels for automotive vehicles and the like, there has been a growing need for improved hydrocarbon fuels which do not give rise to the aforementioned exhaust gas and emissions problems.

German Patent Publication No. 25 23 992 discloses a fuel composition for automotive vehicles. The fuel composition is a lead-free composition, which is alleged to result in a reduction in the production of environmentally harmful components. The fuel composition disclosed in DE 25 23 992 comprises from 10 to 75% gasoline or a gasoline component; from 15 to 40% of methanol, ethanol or a mixture of the same; from 2 to 15% of an ester of acetic acid with an alcohol having from 1 to 6 carbon atoms; and, either in addition to the aforementioned components or in place of the ester of acetic acid, from 4 to 20% higher alcohols. Examples 1 and 2 of DE 25 35 992 are directed to fuel compositions comprising gasoline and reformate as the base hydrocarbon respectively. In both compositions, a major portion of the remaining components is made up of one or more alcohols, in particular methanol and higher alcohols. In the formulations of both Examples 1 and 2, ethyl acetate is present in a minor quantity of 7.2 and 6.8% volume respectively. Example 3 of DE 25 35 992 is directed to a fuel composition consisting of gasoline and alcohols. Example 4 combines gasoline with 22.5% volume methanol and higher alcohols and 2.5 volume % ethyl acetate. It will be noted that all the compositions disclosed in DE 25 35 992 either contain an ester of acetic acid in only a minor amount in combination with a major portion of methanol or higher alcohols, or employ alcohols alone in the absence of an ester.

U.S. Pat. No. 4,806,129 discloses a fuel extender for use with a lead-free gasoline. The extender comprises naphtha as the principal hydrocarbon component, in combination with ethanol and a range of aromatic hydrocarbons, in particular benzene, toluene and xylene. The extender further comprises a stabilizer and a water repellent. The extender is added to lead-free gasoline in an amount of up to 35% volume. Ethanol is present in the extender in a range of amounts of from 3.8 to 6.0% volume. In addition, U.S. Pat. No. 4,806,129 teaches to include isopropyl alcohol in the extender in an amount of from 1.8 to 2.4% volume. As water repellants, U.S. Pat. No. 4,806,129 discloses using either ethyl acetate or methyl isobutyl ketone (MIBK). Each of ethyl acetate and methyl isobutyl ketone may be present in an amount of from 0.2 to 5.75% volume, or more optimally from 0.2 to 3.5% volume, of the extender composition. This equates to the water repellent component being present in the final fuel blend in an amount of up to 2.01% volume. However, the disclosure of U.S. Pat. No. 4,806,129 limits the total content of the water repellent components to be just 4.8 to 20% by volume of the total ethanol content. Thus, the fuel extender and blended fuel compositions of U.S. Pat. No. 4,806,129 comprise ethanol and isopropyl alcohol as the major oxygen-containing component, in combination with a minor stabilizing amount of one or both of ethyl acetate and methyl isobutyl ketone. It is noted that U.S. Pat. No. 4,806,129 indicates a preference for methyl isobutyl ketone as the stabilizing component, due to its higher effectiveness in comparison to ethyl acetate.

European Patent No. 0 708 808 discloses a fuel blend composition, in particular a blend comprising diesel as the base hydrocarbon fuel component. EP 0 708 808 addresses the problem of pollutants being present in the exhaust gases of internal combustion engines operated on conventional diesel blends. EP 0 708 808 notes that a blend containing diesel and up to 15% by volume of ethanol or methanol is been found to improve the quality of exhaust gas emissions, without requiring modifications to existing diesel engine configurations. However, it is also noted that alcohols, such as methanol and ethanol are immiscible with diesel oil, leading to problems with the formulation and storage of the diesel/alcohol fuel blends. As a solution, EP 0 708 808 proposes a fuel blend comprising diesel oil or gasoil, up to 20% by volume of a light alcohol selected from ethanol, n-propanol and mixtures thereof, and up to 15% by volume of a coupling agent. The coupling agent comprises an organic ester. A range of organic esters suitable for use as the coupling agent are disclosed, including fatty esters such as ethyl oleate, ethyl tallowate, iso-propyl oleate, butyl oleate, methyl oleate or methyl cocoate and/or other aromatic esters such as butyl benzoate and/or other aliphatic esters such as methyl acetate or mixtures thereof and/or dicarboxylic acid esters such as dioctyl maleate. A wide range of fuel compositions and fuel additive compositions are exemplified in EP 0 708 808 containing a range of the aforementioned esters. In all the exemplified fuel and additive compositions, the ester is present in only a minor amount in comparison with the alcohol, seemingly in sufficient amount to provide the necessary coupling action and ensure miscibility of the alcohol with the diesel or gasoil fuel.

Current regulations specify that gasoline sold in certain regions of the United States of America that are experiencing high pollution levels and poor air quality should be oxygenated to an oxygen content of 2.7% by weight. Similar proposals are currently being proposed for future regulations regarding the oxygen-containing level of diesel fuel, with a figure of 7% by weight oxygen-content for diesel fuels currently being considered.

Accordingly, it will be appreciated that there is a need for a fuel composition to meet the current and proposed future requirements of the regulations regarding fuel content and emissions levels.

"U.S. Clean Air Act expands role for oxygenates", G.H. Unzelman, Oil & Gas Journal, Apr. 15, 1991, discusses the issue of oxygenates in fuels, in particular gasoline. A wide range of oxygen-containing compounds for possible inclusion in gasoline blends are mentioned, including alcohols, ethers and esters. It is stated that the oxygenates most likely to be suitable candidates for use in gasoline are ethers, such as methyl tertiary butyl ether (MTBE), ethyl tertiary butyl ether (ETBE) and tertiary amyl methyl ether (TAME), and alcohols, such as methanol, ethanol and tertiary butyl alcohol (TBA). Esters are mentioned as possible oxygen-containing compounds for use in gasoline. Methyl acetate, ethyl acetate and isopropyl acetate are specifically mentioned. However, their proposed use is limited to gasoline blending components to be used in conjunction with methanol as the oxygen-providing component of the gasoline.

SUMMARY OF THE INVENTION

The Applicants have found that a range of oxygen-containing organic compounds, specifically a group of organic esters, may be blended into fuel compositions, in particular gasoline and diesel, and function as the oxygen-containing component of the fuel. It has been found that a fuel composition may be prepared using these oxygen-containing compounds to meet the current and proposed requirements regarding fuel oxygen content. Surprisingly, the compounds may be blended in the fuel composition and function as the major oxygen-providing agent of the oxygen-containing component of the fuel, reducing or eliminating the need for the fuel to contain an alcohol. The avoidance of alcohols, in particular ethanol, as the major oxygen-contributing component of the fuel represents a significant advantage. Further, the compounds of the present invention remove the need to formulate the fuel with MTBE, again representing a significant advantage in the art of preparing fuel compositions, in particular fuels for automotive vehicles.

Accordingly, the present invention provides a fuel blend for use in an internal combustion engine, the fuel blend comprising:

a hydrocarbon-containing fuel component;

an oxygen-containing component capable of providing oxygen for combustion of the fuel component under conditions prevailing during the combustion cycle of the internal combustion engine;

wherein the major oxygen-providing agent of the oxygen-containing component is one or more compounds having the general formula (I):

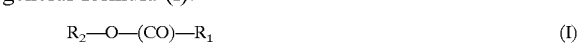

$$R_2—O—(CO)—R_1 \quad (I)$$

wherein $R_1$ is selected from hydrogen, lower alkyl, lower alkenyl and lower alkynyl groups;

$R_2$ is selected from lower alkyl, lower alkenyl and lower alkynyl groups, or a group having the general formula (II):

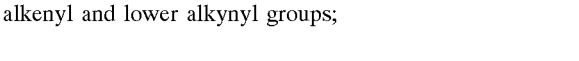

$$R_3—(CO)—O—R_4— \quad (II)$$

wherein $R_3$ is selected from lower alkyl, lower alkenyl and lower alkynyl groups; and $R_4$ is selected from lower alkyl groups.

In a second aspect, the present invention provides a novel oxygenating additive for addition to a fuel, in particular a fuel for use with an internal combustion engine. In this second aspect an oxygenating additive for a hydrocarbon-containing fuel is provided, the additive comprising:

a first compound having a general formula (III):

$$R_7—(CO)—O—R_6—O—(CO)—R_5 \quad (III)$$

wherein $R_5$ is selected from lower alkyl, lower alkenyl and lower alkynyl groups;

$R_6$ is selected from lower alkyl; and wherein $R_7$ is selected from lower alkyl, lower alkenyl and lower alkynyl groups; and a second compound having a general formula (IV):

$$R_9—O—(CO)—R_8 \quad (IV)$$

wherein $R_8$ is selected from hydrogen, lower alkyl, lower alkenyl and lower alkynyl groups; and $R_9$ is selected from lower alkyl, lower alkenyl and lower alkynyl groups.

Specific details and embodiments of the compositions of the present invention will now be described in detail. The detailed description of these embodiments are by way of example only and are not intended to limit the scope of the present invention.

DETAILED DESCRIPTION OF THE INVENTION

The fuel blend of the present invention comprises a hydrocarbon-containing fuel component. The hydrocarbon-containing fuel component is a fuel suitable for use in powering an internal combustion engine. Such fuels are well known in the art. The fuel component is preferably gasoline or diesel, for which the present invention is particularly advantageous if applied. A fuel blend according to the present invention may also be prepared using other hydrocarbon components to be used as a fuel, in applications where it is required or desirable that the fuel blend contains an oxygen-containing component for providing oxygen during the combustion of the fuel. The fuel blend further comprises an oxygen-containing component capable of providing oxygen for combustion of the fuel component under the conditions prevailing during the combustion cycle of the internal combustion engine. The oxygen-containing component comprises compounds having one or more oxygen atoms as a constituent. Under the conditions prevailing during the combustion of the fuel blend within the internal combustion engine, the oxygen is released from the oxygen-containing component to act as an oxidizing agent for the molecules of the hydrocarbon fuel component. It will be understood that, while the oxygen-containing component of the fuel blend of the present invention will provide oxygen for combustion of the hydrocarbon-containing fuel component, in most cases, the major portion of the oxygen required during the combustion phase of the engine's operation will come for another source, most likely air and/or an oxygen-containing gas, for example nitrous oxide.

It is an aspect of this invention that the major oxygen-providing agent of the oxygen-containing component of the fuel blend is one or more compounds selected from a specific group of organic esters, as will be defined and described in further detail hereinafter. In this respect, the term "major oxygen-providing agent" as used in the present specification is to be taken to be a reference to that constituent of the oxygen-containing component of the fuel blend that, under the conditions prevailing during the combustion cycle of the internal combustion engine, contributing the major portion of the oxygen provided in this manner. In this respect, the provision during fuel combustion of oxygen from the oxygen-containing component of the fuel is to be contrasted with oxygen provided in the conventional manner from an oxygen-containing gas, typically air, supplied to the engine together with the fuel, as discussed above.

In the fuel blend of the present invention, the major oxygen-providing agent of the oxygen-containing component is one or more compounds having the general formula (I):

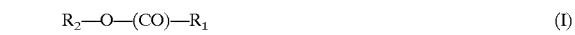

$$R_2—O—(CO)—R_1 \quad (I)$$

The compounds of formula (I) are a select group of organic esters. In the compound of formula (I), $R_1$ is selected from hydrogen, lower alkyl, lower alkenyl, and lower alkynyl. In the present specification, the term "alkenyl" is a reference to an unsaturated substituent group having one or more carbon-carbon double bonds. Similarly, the term "alkynyl" is a reference to an unsaturated substituent group having one or more carbon-carbon triple bonds.

For the purposes of the fuel blend of the present invention, the compounds of formula (I) should be soluble in the other components of the blend, in particular the hydrocarbon fuel component. In the,present specification, references to "lower alkyl", "lower alkenyl" and "lower alkynyl" groups are references to such groups having a size that allows the compound to be soluble in the hydrocarbon fuel component. In this respect, it is preferred that the alkyl groups have from 1 to 4 carbon atoms, alkenyl groups have from 2 to 4 carbon atoms, and alkynyl groups have from 2 to 4 carbon atoms.

The carbon-containing groups represented by $R_1$ and $R_2$ may be straight chain or branched. Some preferred compounds of formula (I) are ones in which $R_1$ is hydrogen. In other compounds, $R_1$ is preferably selected from the lower members of the aforementioned groups, especially methyl, ethyl, ethenyl and ethynyl groups. However, it is preferred that $R_1$ is a saturated substituent group, that is an alkyl group. Suitable groups include n-propyl and iso-propyl. Lower alkyl groups are particularly suitable groups for $R_1$. It is especially preferred for $R_1$ to be a methyl group.

In the compound of general formula (I), $R_2$ may be selected from lower alkyl, lower alkenyl and lower alkynyl groups, as hereinbefore defined. $R_2$ is preferably selected from the lower members of the aforementioned groups, especially methyl, ethyl, ethenyl and ethynyl groups. However, it is preferred that $R_2$ is a saturated substituent group, that is an alkyl group. When selected from this group of substituents, $R_2$ is preferably a lower alkyl group, with methyl and ethyl being especially preferred lower alkyl groups.

In one preferred embodiment of the invention, both $R_1$ and $R_2$ are methyl, that is the compound of general formula (I) is methyl acetate. In a second preferred embodiment, $R_1$ is methyl and $R_2$ is ethyl, that the compound of general formula (I) is ethyl acetate. Specific compounds in which $R_1$ is hydrogen include methyl formate and ethyl formate. A specific compound in which $R_2$ is a branched carbon-containing group is tertiary butyl acetate.

In the alternative, the compound of general formula (I) may be a compound in which $R_2$ is a group of general formula (II), as follows:

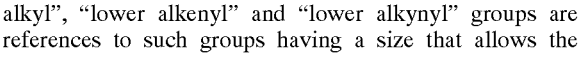

$$R_3—(CO)—O—R_4— \quad (II)$$

In the group of general formula (II), $R_3$ is selected from lower alkyl, lower alkenyl and lower alkynyl, as hereinbefore defined. $R_3$ is preferably selected from the lower members of the aforementioned groups, especially methyl, ethyl, ethenyl and ethynyl groups. However, it is preferred that $R_3$ is a saturated substituent group, that is an alkyl group. Preferred moieties for $R_3$ are the lower alkyl groups, with methyl and ethyl being especially preferred.

In the group of general formula (II), $R_4$ is a lower alkyl group, as hereinbefore defined, with methyl and ethyl being especially preferred.

In one embodiment of the present invention, the compound of general formula (I) is ethylene glycol diacetate.

The fuel blend of the present invention may comprise an oxygen-containing component in which the major oxygen-providing agent is a single compound. The single compound is one of the compounds of formula (I) described generally and specifically above. Thus, in preferred embodiments, the major oxygen-providing agent consists of one of methyl acetate, ethyl acetate or ethylene glycol diacetate. Each of these preferred compounds may be employed with a wide range of hydrocarbon fuel components. However, it has been found advantageous to prepare a fuel blend from gasoline and one of methyl acetate or ethyl acetate as the major oxygen-providing agent. A preferred fuel blend containing diesel as the hydrocarbon fuel employs methyl acetate or ethyl acetate as the major oxygen-providing agent. Ethyl acetate is a particularly preferred compound for use as a sole major oxygen-providing agent in the fuel blend of the present invention.

In alternative embodiments, the fuel blend may comprise a major oxygen-providing agent itself being a blend of two or more different compounds, each having the general formula (I) as defined above. The fuel blend may comprise any two or more of the compounds described in both general terms and specifically above.

In a first embodiment in this regard, the major oxygen-providing component comprises a first compound and a second compound, both of formula (I), in which $R_1$ in both the first compound and the second compound is selected from lower alkyl, lower alkenyl and lower alkynyl groups. In this embodiment, $R_1$ in both the first and second compounds is preferably selected from lower alkyl groups. The first and second compounds may have $R_1$ being the same group or different groups. In this first embodiment, it is preferred that both the first and second compounds are compounds of general formula (I), in which $R_2$ is selected from lower alkyl groups. In such a case, it is preferred that $R_2$ of the first compound is a different alkyl group to that of the second compound. In this respect, it is preferred that the first compound of the blend is a compound of formula (I), in which $R_2$ is ethyl, and the second compound is a compound of general formula (I), in which $R_2$ is methyl.

It is an especially preferred embodiment of the present invention for the major oxygen-providing component to comprise ethyl acetate and methyl acetate. A blend consisting of these two components has been found to be particularly suitable for use as the major oxygen-providing agent in the fuel blends of this invention.

In this embodiment, the first and second compounds may be present in the major oxygen-providing component in any suitable ratio. The ratio employed will depend, at least in part, upon the physical properties of the oxygen containing compounds of general formula (I) being employed and the target properties of the fuel blend being prepared. The physical properties of the compounds which may be important include vapour pressure, boiling point, density and miscibility with the hydrocarbon-containing fuel. Relevant properties of the fuel blend being prepared include octane number (for gasoline blends), cetane number (for diesel blends), vapour pressure, density, and viscosity. In embodiments in which the major oxygen-providing component comprises a first compound of formula (I), in which $R_2$ is ethyl, and a second compound in which $R_2$ is methyl, it is preferred to have the first and second compounds present in a ratio of from 0.1:10 to 10:0. 1, more preferably from 0.5:5 to 5:0.5. More preferred is to employ a ratio in the range of from 1:5 to 5:1, especially from 1:1 to 1:1.5.

One preferred blend for use as the major oxygen-providing component consists of ethyl acetate and methyl acetate in a ratio in the range of from 1:1 to 1:1.5.

In a second embodiment in this regard, the major oxygen-providing component comprises a first compound and a second compound, both of formula (I), in which $R_2$ in the first compound is a group of general formula (II) and $R_2$ in the second compound is selected from lower alkyl, lower alkenyl and lower alkynyl groups.

In this embodiment, $R_2$ in the second compound is preferably selected from lower alkyl groups, with methyl and ethyl being particularly preferred.

As noted, in this embodiment, $R_2$ in the first compound is a group of formula (II), as generally and specifically defined and described above. $R_3$ is preferably a lower alkyl group, with methyl and ethyl being especially preferred. $R_4$ in the group of general formula (II) is preferably a lower alkyl group, with ethyl being especially preferred.

The first compound preferably has $R_1$ selected from lower alkyl groups, with methyl and ethyl being especially preferred.

The first compound of this embodiment is preferably ethylene glycol diacetate.

The second compound preferably has $R_1$ selected from lower alkyl groups, with methyl and ethyl being especially preferred.

Methyl acetate and ethyl acetate are particularly preferred for use as the second compound.

In this second embodiment of a blend, the first and second compounds may be present in any suitable ratio, determined by the factors discussed above with respect to the first embodiment. Preferably, the first and second compounds are present in a ratio in the range of from 0.1:20 to 20:1, more preferably from 0.5:1 to 10:1. A preferred ratio is in the range of from 1:1 to 5:1.

This second embodiment offers an advantage. Compounds of general formula (I), in which $R_2$ is a group of general formula (II), are useful compounds for use in the formulation of diesel fuels. As noted above, ethylene glycol diacetate is a suitable compound for inclusion in diesel fuels as the major oxygen-providing agent. However, it has been found that ethylene glycol diacetate is not readily miscible in certain diesel fuels. However, by employing a mixture of ethylene glycol diacetate and a compound of general formula (I) in which $R_2$ is a group as defined above other than one of general formula (II), allows ethylene glycol diacetate to enter into solution with the diesel fuel. Preferred compounds for use in this respect are methyl acetate and ethyl acetate. Accordingly, applied generally, this second embodiment should preferably employ the first and second compounds in such amounts that both compounds are rendered miscible with the hydrocarbon fuel with which they are blended.

It will be appreciated that the major oxygen-providing component may comprise a blend of three or more compounds of general formula (I) defined above.

The compounds of general formula (I) as defined and discussed above offer significant advantages over other oxygen-containing compounds, when used in the formulation of fuel blends. In this respect, it is important that a number of requirements are met by the components of a fuel blend. First, it is important that any component of a fuel be as low in toxicity as possible. The compounds of general formula (I) are low in toxicity.

Second, it is important when blending a fuel composition that the requirements regarding vapour pressure of the final composition be met. Currently, it is permitted to blend gasoline to a Reid Vapour Pressure of up to 7 psi. However, it is desirable to blend gasoline to meet a vapour pressure lower than this figure. Indeed, it is currently proposed to limit the Reid Vapour Pressure of gasoline to 2 psi. MTBE has a Reid Vapour Pressure of about 7 psi. Accordingly, it will become problematic to blend gasoline using MTBE if lower vapour pressure requirements are to be met. Compounds of general formula (I) can be employed without this disadvantage. For example, ethyl acetate has a Reid Vapour Pressure of 2.3 psi, that is about one third that of MTBE. This lower vapour pressure allows ethyl acetate to be blended with other components with fewer problems arising with meeting vapour pressure requirements for the final blend, than compared with blending with MTBE, for example.

Further, when blending gasoline, it is important that the requirements regarding octane number are met by the final blend. In this respect, it is advantageous to have the octane numbers of the individual components to be as high as possible. Compounds of general formula (I) exhibit advantageously high octane numbers. For example, ethyl acetate has an octane number of 116, compared with an octane number of 110 for MTBE. Accordingly, ethyl acetate offers significant advantages when blending gasoline to meet octane number targets.

It will also be clear that the oxygen content of the oxygen-containing component is an important factor. Employing as the oxygen-providing agent a compound having a higher amount of oxygen reduces the overall amount of the agent required in order to achieve targets relating to oxygen content of the final fuel blend. The compounds of general formula (I) have a minimum of two oxygen atoms in each molecule. This is to be compared with the single oxygen atom present in ethers, such as MTBE. This translates into a corresponding reduction in the amount of the oxygen-providing agent required to be included in the fuel blend in order to meet the desired or required oxygen content of the final fuel.

Further important factors include flash point, flammability and heat value. In terms of components currently employed in fuel blends, the compounds of general formula (I) have high flash points, high flammability values and high heat values. These characteristics further enhance the advantages of the fuel blend of the present invention.

While not regulated, a number of additional factors are playing an increasing role in the blending of fuel compositions. First, it is desirable that any component of a fuel blend be biodegradable. Ethers are not biodegradable. In contrast, the compounds of general formula (I) are readily broken down by bacteria in the environment. Accordingly, the adverse impact of compounds of general formula (I) entering the environment, for example by way of a spill or a leak, would be significantly less than compared with ethers, such as MTBE. In addition, odour of the components of a fuel can give rise to problems. In this respect, the compounds of general formula (I), being esters, do not suffer the malodorous characteristics of ethers, such as MTBE.

Accordingly, it will be appreciated that the compounds of general formula (I) offer significant advantages in the preparation of fuel blend from hydrocarbon components.

In certain circumstances or for certain applications, it may be preferred to include in the fuel blend of the present invention one or more stabilizers. At least one alcohol may be present in the blend as a stabilizer. Alcohols having from 1 to 8 carbon atoms are particularly suitable for use as stabilizers in the blends of this invention, with alcohols having from 2 to 5 carbon atoms being especially suitable. Ethanol is a particularly suitable alcohol for use as a stabilizer. In contrast to the fuel compositions of the prior art, alcohols, if employed in the fuel blend of the present invention, are present only to perform the function of stabilizing the composition. Alcohols present in the fuel blend, while they will contribute oxygen during the combustion of the fuel in an internal combustion engine, are not employed to provide the oxygen required during combustion. Accordingly, the alcohols, if employed, may be present in very low concentrations, in comparison to the compound or compounds of general formula (I). The compound of general formula (I) and the stabilizer may be present in a ratio in the range of from 10:1 to 300:1, more preferably from 20:1 to 150:1. Especially preferred ratios of compound of general formula (I) to stabilizer are in the range of from 75:1 to 125:1.

Further, it can be advantageous to include in the formulation an alcohol bearing one or more substituents. The alcohol is preferably an alkanol. The alcohol preferably has from 2 to 10 carbon atoms, more preferably from 2 to 5 carbon atoms. Butyl alcohols are a particularly preferred group of alcohols for inclusion in the blend. Substituents on the alcohol may include alkyl, alkenyl and alkynyl groups, with alkyl substituents being especially preferred. Alkyl substituents preferably have from 1 to 4 carbon atoms, with methyl and ethyl substituents being especially preferred. A most suitable substituted alcohol for inclusion in the fuel blend is tertiary butyl alcohol.

The substituted alcohol, if present in the blend, is preferably present in a ratio to the compound of general formula (I) of from 1:0.6 to 1:10, more preferably from 1:0.6 to 1:5. A most suitable fuel blend is one in which the substituted alcohol and the compound of general formula (I) are present in a ratio in the range of from 1:1 to 1:2. A ratio in this range is particularly advantageous when the hydrocarbon-containing fuel component of the fuel blend is diesel.

It has been found to be advantageous to include in the fuel blend a biocide. In general, hydrocarbon fuels are not media which readily support the growth of bacteria and other organisms. However, the compounds of general formula (I), when present in the fuel blend in combination with water, can provide a substrate capable of supporting the growth of organisms, such as bacteria. Accordingly, for applications where it is considered inevitable or likely that the fuel blend will become contaminated with water, it is preferred to include a biocide in the blend.

Suitable biocides for inclusion in the fuel blend of the present invention are available commercially and include Racor Diesel Fuel Biocide (EPA registration No. 1448-172-47099). The biocide, if included, should be present in an amount sufficient to prevent the growth of organisms. Accordingly, the amount of biocide required to be included in the fuel composition will depend upon the biocide to be employed, the environment to which the fuel blend will be exposed, and the length of time of such exposure. The concentration of biocide required for a given set of circumstances may be determined by routine experimentation. In general, the biocide may be present in an amount in the range of 0.005 to 0.02% by volume.

For fuel blends in accordance with the present invention in which the hydrocarbon-containing fuel is gasoline, it is preferred that the compound of general formula (I) is present in an amount to provide an oxygen-content in the fuel blend of at least 1% by weight, more preferably in the range of from 1 to 5% by weight. Preferably, the oxygen-content is at least 2% by weight. By having the compound of general formula (I) present in an amount to provide an oxygen-content in the fuel blend of at least 2.7% by weight, the fuel blend of the present invention will meet the requirements of legislation mentioned above. It will be understood that the compound of general formula (I) may be present in higher amounts, as required by the duty to be performed by the fuel. The amount of the compound of general formula (I) to be included in the fuel blend in order to meet the aforementioned oxygen levels will depend upon the oxygen-content of the compound itself, together with the relative molecular weights of the components of the blend. This however may be readily calculated for a given blend.

Similarly, fuel blends in which the hydrocarbon-containing fuel is diesel benefit from having the compound of general formula (I) present in an amount sufficient to provide an oxygen-content in the blend in the range of from 1 to 10% by weight. Preferably the oxygen-content is at least 5% by weight. An amount sufficient to provide an oxygen-content of 7% by weight or greater will meet currently proposed legislative requirements, as discussed above.

In a further aspect, the present invention provides the use of a compound having general formula (I) as defined hereinbefore as an oxygen-providing component in a fuel blend. In particular, the present invention provides the use of a compound of general formula (I) as defined hereinbefore as the major oxygen-providing agent of the oxygen-providing component of a fuel blend.

As discussed above, it is an embodiment of the present invention that the fuel blend comprises an oxygen-containing component having as the major oxygen-providing agent a blend of oxygen-containing compounds. In a further aspect, the present invention provides an oxygenating additive for use in a hydrocarbon-containing fuel, the oxygenating additive comprising:

a first compound having a general formula (III):

$$R_7—(CO)—O—R_6—O—(CO)—R_5 \quad (III)$$

wherein $R_5$ is selected from lower alkyl, lower alkenyl and lower alkynyl groups;

$R_6$ is selected from lower alkyl; and wherein $R_7$ is selected from lower alkyl, lower alkenyl and lower alkynyl groups; and a second compound having a general formula (IV):

$$R_9—O—(CO)—R_8 \quad (IV)$$

wherein $R_8$ is selected from hydrogen, lower alkyl, lower alkenyl and lower alkynyl groups; and $R_8$ is selected from lower alkyl, lower alkenyl and lower alkynyl groups.

Referring to the compounds of general formula (III), the groups represented by $R_5$ may be straight chain or branched. $R_5$ is preferably selected from the lower members of the aforementioned groups, especially methyl, ethyl, ethenyl and ethynyl groups. However, it is preferred that $R_5$ is a saturated substituent group, that is an alkyl group. Suitable groups include n-propyl and iso-propyl. Lower alkyl groups are particularly suitable as $R_5$, in particular methyl and ethyl. It is especially preferred for $R_5$ to be a methyl group.

In the compound of general formula (III), $R_6$ is a lower alkyl group, as hereinbefore defined, with methyl and ethyl being especially preferred.

The groups represented by $R_7$ may be straight chain or branched. $R_7$ is preferably selected from the lower members of the aforementioned groups, especially methyl, ethyl, ethenyl and ethynyl groups. However, it is preferred that $R_7$ is a saturated substituent group, that is an alkyl group. Suitable groups include n-propyl and iso-propyl. Lower alkyl groups are particularly suitable as $R_7$, in particular methyl and ethyl. It is especially preferred for $R_7$ to be a methyl group.

In a preferred embodiment, the compound of general formula (III) is ethylene glycol diacetate.

In addition to the compound of general formula (III), the oxygenating additive of this aspect of the invention also comprises a compound of general formula (IV). The compounds of formula (IV) are a specific group of organic esters. In the compound of formula (IV), $R_8$ is selected from hydrogen, lower alkyl, lower alkenyl, and lower alkynyl. The carbon-containing groups represented by $R_8$ may be straight chain or branched. $R_8$ is hydrogen in certain preferred compounds. $R_8$ is preferably selected from the lower members of the aforementioned groups, especially methyl, ethyl, ethenyl and ethynyl groups. However, it is preferred that $R_8$ is a saturated substituent group, that is an alkyl group. Suitable groups include n-propyl and iso-propyl. Lower alkyl groups are particularly suitable groups for $R_8$. It is especially preferred for $R_8$ to be a methyl group.

In the compound of general formula (IV), $R_9$ may be straight chain or branched and is selected from lower alkyl, lower alkenyl and lower alkynyl groups, as hereinbefore defined. $R_9$ is preferably selected from the lower members of the aforementioned groups, especially methyl, ethyl, ethenyl and ethynyl groups. However, it is preferred that $R_9$ is a saturated substituent group, that is an alkyl group. When selected from this group of substituents, $R_9$ is preferably a lower alkyl group, with methyl and ethyl being especially preferred lower alkyl groups.

In one preferred embodiment of the invention, both $R_8$ and $R_9$ are methyl, that is the compound of general formula (IV) is methyl acetate. In a second preferred embodiment, $R_8$ is methyl and $R_9$ is ethyl, that is the compound of general formula (IV) is ethyl acetate. In further preferred embodiments, the compound of general formula (IV) is one or more of methyl formate, ethyl formate and tertiary butyl acetate.

It is especially preferred that the oxygenating additive of this aspect of the present invention comprises a combination of ethylene glycol diacetate and one or a mixture of methyl acetate and ethyl acetate.

The compound of general formula (III) and the compound of general formula (IV) may be present in the additive in a range of ratios. Preferably, the compound of general formula (III) and the compound of general formula (IV) are present in a ratio in the range of from 0.1:1 to 10:1, more preferably 0.5:1 to 5:1, with a ratio in the range of from 1:1 to 2.5:1 being especially preferred. As noted above, it has been found that some compounds of general formula (III) are not readily soluble in hydrocarbon fuels. In such cases, the ratio of the compound of general formula (III) to the compound of general formula (IV) should be such that the components of the additive are rendered readily soluble in the fuel in which the additive is to be blended.

It will be understood that the oxygenating additive may comprise a single compound of general formula (III), or a combination of two or more such compounds. Similarly, the additive may comprise a single compound of general formula (IV), or a combination of two or more such compounds.

The compounds of general formulae (III) and (IV) have the characteristics discussed above, with reference to compounds of general formula (I). Accordingly, the additive composition of the present invention offers significant advantages when employed in the formulation of hydrocarbon fuel blends.

The oxygenating additive of this aspect of the present invention may consist of a compound of general formula (III) and a compound of general formula (IV). Alternatively, other components may be present. In particular, as noted above, it may be desirable to include in a fuel blend comprising compounds of general formulae (III) and (IV) a biocide, in order to prevent the growth of bacteria and other organisms. The biocide may be blended with the other components of the oxygenating additive at the time of its preparation. It is advantageous, however, to include a biocide in the oxygenating additive of the present invention. Suitable biocides for inclusion in the oxygenating additive are discussed above. The biocide, if included in the oxygenating additive, should be present in an amount sufficient to prevent the growth of organisms in the final fuel blend. Accordingly, the biocide, if included, should be present in an amount sufficient to provide a concentration in the final fuel blend in the ranges indicated above.

For similar reasons, it may be convenient and advantageous to include in the oxygenating additive of the present invention a stabilizer. Suitable stabilizers are discussed above. The stabilizers are to be present in the amounts indicated above.

In addition, the oxygenating additive may comprise a substituted alcohol, as discussed above, if it is desired to be included in the final fuel blend. The amounts of the substituted alcohol, if present, are as indicated above.

In one preferred embodiment, the oxygenating additive of the present invention consists of a compound of general formula (III), a compound of general formula (IV), a biocide and a stabilizer. Such a formulation may further include a substituted alcohol.

In a further aspect, the present invention provides the use of an additive comprising a compound of general formula (III) and a compound of general formula (IV) as hereinbefore defined as an oxygen-containing component of a hydrocarbon fuel blend.

As mentioned above, in one embodiment, a fuel blend according to the present invention may comprise two or more different compounds of general formula (I), as hereinbefore defined, in which $R_1$ may be hydrogen or both $R_1$ and $R_2$ are independently selected from lower alkyl, lower alkenyl and lower alkynyl groups. Accordingly, in still a further aspect, the present invention provides a fuel additive composition comprising such a combination of two or more different compounds of general formula (I). The additive composition preferably comprises two or more compounds of formula (I), in which both $R_1$ and $R_2$ are independently selected from lower alkyl groups. Preferably, the additive comprises a mixture of ethyl acetate and methyl acetate. One additive composition according to this aspect of the invention comprises ethyl acetate and methyl acetate in a ratio of from 1:5 to 5:1, preferably in a ratio of from 1:2 to 2:1, with a ratio of 1:1 being particularly preferred. The additive may additionally comprise one or more of a stabilizer, biocide and substituted alcohol, as described above. The present invention further provides the use of such an additive as an oxygen-containing component of a fuel blend.

The compounds of general formulae (I), (III) and (IV) employed in the present invention are known compounds, available commercially. Being esters, these compounds may be prepared by the reaction of the appropriate alcohol with the appropriate carboxylic acid in either batch or continuous process schemes known to the person skilled in the art.

The fuel blend and oxygenating additive of the present invention may be prepared using blending and formulation techniques well known in the art to the person skilled in the art.

The present invention will be further described by way of the following examples, which are included for illustrative purposes only. The amounts indicated in the blends of following examples are in percent volume, unless otherwise indicated.

EXAMPLE 1

A fuel blend according the present invention comprises the following components in the following approximate amounts:

| | |
|---|---|
| Gasoline | 94.0% |
| Ethyl Acetate | 6.0% |

The gasoline component is a baseline gasoline having an octane number of 84. The fuel blend has a calculated octane number of 87 and a Reid vapour pressure of 7 psi. The blend contains 2.4% by weight of oxygen.

EXAMPLE 2

A fuel blend according the present invention comprises the following components in the following approximate amounts:

| | |
|---|---|
| Gasoline | 93.0% |
| Ethyl Acetate | 7.0% |

The gasoline component is a baseline gasoline having an octane number of 84. The fuel blend has a calculated octane number of 87 and a Reid vapour pressure of about 7 psi. The blend contains 2.7% by weight of oxygen.

EXAMPLE 3

A fuel blend according the present invention comprises the following components in the following approximate amounts:

| | |
|---|---|
| Gasoline | 94.9% |
| Ethyl acetate | 5.1% |

The gasoline component is a baseline gasoline having an octane number of 84. The fuel blend has a calculated octane number of 87 and a Reid vapour pressure of about 7 psi. The blend contains 2.0% by weight of oxygen.

EXAMPLE 4

A fuel blend according the present invention comprises the following components in the following approximate amounts:

| | |
|---|---|
| Gasoline | 95.2% |
| Methyl Acetate | 4.8% |

The gasoline component is a baseline gasoline having an octane number of 84. The fuel blend has a calculated octane number of 87 and a Reid vapour pressure of about 7 psi. The blend contains 2.0% by weight of oxygen.

EXAMPLE 5

A fuel blend according the present invention comprises the following components in the following approximate amounts:

| | |
|---|---|
| Gasoline | 93.3% |
| Methyl Acetate | 6.7% |

The gasoline component is a baseline gasoline having an octane number of 84. The fuel blend has a calculated octane number of 87 and a Reid vapour pressure of about 7 psi. The blend contains 2.7% by weight of oxygen.

EXAMPLE 6

A fuel blend according the present invention comprises the following components in the following approximate amounts:

| | |
|---|---|
| Gasoline | 94.0% |
| Methyl Acetate | 3.0% |
| Ethyl Acetate | 3.0% |

The gasoline component is a baseline gasoline having an octane number of 84. The fuel blend has a calculated octane number of 87 and a Reid vapour pressure of about 7 psi. The blend contains 2.2% by weight of oxygen.

EXAMPLE 7

A fuel blend according the present invention comprises the following components in the following approximate amounts:

| | |
|---|---|
| Gasoline | 93.97% |
| Methyl Acetate | 3.0% |
| Ethyl Acetate | 3.0% |
| Ethanol | 0.03% |

The gasoline component is a baseline gasoline having an octane number of 84. The ethanol is present as a stabilizer. The fuel blend has a calculated octane number of 87 and a Reid vapour pressure of about 7 psi. The blend contains 2.2% by weight of oxygen.

EXAMPLE 8

A fuel blend according the present invention comprises the following components in the following approximate amounts:

| | |
|---|---|
| Gasoline | 93.0% |
| Ethyl Acetate | 5.5% |
| Ethylene Glycol Diacetate | 1.5% |

The gasoline component is a baseline gasoline having an octane number of 84. The fuel blend has a calculated octane number of 87 and a Reid vapour pressure of about 7 psi. The blend contains 2.7% by weight of oxygen.

EXAMPLE 9

A fuel blend according the present invention comprises the following components in the following approximate amounts:

| | |
|---|---|
| Gasoline | 94.0% |
| Ethyl Acetate | 3.0% |
| Tertiary Butyl Alcohol | 3.0% |

The gasoline component is a baseline gasoline having an octane number of 84. The fuel blend has a calculated octane number of 85.5 and a Reid vapour pressure of about 7 psi. The blend contains 1.5% by weight of oxygen.

EXAMPLE 10

A fuel blend according the present invention comprises the following components in the following approximate amounts:

| | |
|---|---|
| Diesel | 94.45% |
| Ethylene Glycol Diacetate | 4.13% |
| Methyl Acetate | 1.42% |

The blend contains 7.0% by weight of oxygen.

EXAMPLE 11

A fuel blend according the present invention comprises the following components in the following approximate amounts:

| | |
|---|---|
| Diesel | 88.0% |
| Ethylene Glycol Diacetate | 4.0% |
| Ethyl Acetate | 8.0% |

The blend contains 7.0% by weight of oxygen.

EXAMPLE 12

A fuel blend according the present invention comprises the following components in the following approximate amounts:

| | |
|---|---|
| Diesel | 86.8% |
| Ethylene Glycol Diacetate | 6.6% |
| Methyl Acetate | 3.3% |
| Ethyl Acetate | 3.3% |

The blend contains 7.0% by weight of oxygen.

EXAMPLE 13

A fuel blend according the present invention comprises the following components in the following approximate amounts:

| | |
|---|---|
| Diesel | 83.99% |
| Ethylene Glycol Diacetate | 8.0% |
| Methyl Acetate | 6.0% |
| Biocide | 0.01% |

The biocide is Racor Diesel Fuel Biocide. The blend contains 7.0% by weight of oxygen.

EXAMPLE 14

A fuel blend according the present invention comprises the following components in the following approximate amounts:

| | |
|---|---|
| Diesel | 93.98% |
| Ethylene Glycol Diacetate | 4.0% |
| Methyl Acetate | 1.95% |
| Ethanol | 0.05% |
| Biocide | 0.02% |

Ethanol is present as a stabilizer. The biocide is Racor Diesel Fuel Biocide. The blend contains 3.4% by weight of oxygen.

EXAMPLE 15

A fuel blend according the present invention comprises the following components in the following approximate amounts:

| | |
|---|---|
| Diesel | 86.0% |
| Ethylene Glycol Diacetate | 6.0% |
| Ethyl Acetate | 4.0% |
| Tertiary Butyl Alcohol | 4.0% |

The blend contains 6.0% by weight of oxygen.

EXAMPLE 16

An oxygenating additive according to the present invention comprises the following components:

| | |
|---|---|
| Methyl Acetate | 66.0% |
| Ethylene Glycol Diacetate | 34.0% |

The additive contains 42.4% by weight of oxygen.

EXAMPLE 17

An oxygenating additive according to the present invention comprises the following components:

| | |
|---|---|
| Ethyl Acetate | 55.0% |
| Ethylene Glycol Diacetate | 45.0% |

The additive contains 40.1% by weight of oxygen.

EXAMPLE 18

An oxygenating additive according to the present invention comprises the following components:

| | |
|---|---|
| Ethyl Acetate | 49.99% |
| Ethylene Glycol Diacetate | 49.99% |
| Biocide | 0.02% |

The biocide is Racor Diesel Fuel Biocide. The additive contains 40.5% by weight of oxygen.

EXAMPLE 19

An oxygenating additive according to the present invention comprises the following components:

| | |
|---|---|
| Ethyl Acetate | 33.0% |
| Methyl Acetate | 33.0% |
| Ethylene Glycol Diacetate | 33.9% |
| Ethanol | 0.1% |

Ethanol is present in the additive to act as a stabilizer in the final fuel blend. The additive contains 41.4% by weight of oxygen.

EXAMPLE 20

An oxygenating additive according to the present invention comprises the following components:

| | |
|---|---|
| Ethyl Acetate | 50.0% |
| Ethylene Glycol Diacetate | 25.0% |
| Tertiary Butyl Alcohol | 25.0% |

The additive contains 40.1% by weight of oxygen.

While the preferred embodiments of the present invention have been described above, it is not intended that these be taken to limit the scope of the present invention and modifications thereof can be made by one skilled in the art without departing from the spirit of the present invention.

What we claim is:

1. A fuel blend for use in an internal combustion engine, the fuel blend comprising:

a hydrocarbon-containing fuel component selected from the group consisting of gasoline and diesel;

an oxygen-containing component capable of providing oxygen for combustion of the fuel component under conditions prevailing during the combustion cycle of the internal combustion engine, the oxygen-containing component providing substantially all of the oxygen derived from the fuel blend in this manner;

wherein the oxygen-containing component is one or more compounds having the general formula (I):

$$R_2—O—(CO)—R_1 \quad (I)$$

wherein $R_1$ is selected from lower alkyl, lower alkenyl and lower alkynyl groups;

$R_2$ is selected from lower alkyl, lower alkenyl and lower alkynyl groups, or a group having the general formula (II):

$$R_3—(CO)—O—R_4— \quad (II)$$

wherein $R_3$ is selected from lower alkyl, lower alkenyl and lower alkynyl groups; and $R_4$ is selected from lower alkyl groups, the oxygen-containing component being present in an amount sufficient to provide an oxygen-content in the fuel blend of at least 1% by weight wherein when the said oxygen-containing component is only of general formula (I) that does include R2 being of general formula (II) the said component is selected from the group consisting of tertiary butyl acetate, ethylene glycol diacetate and a mixture of at two component of formula (I).

2. A fuel blend as claimed in claim 1, wherein the compound of general formula (I) is tertiary butyl acetate.

3. A fuel blend as claimed in claim 1, wherein $R_2$ is a group of general formula (II), in which $R_3$ is a $C_1$ to $C_4$ alkyl.

4. A fuel blend as claimed in claim 3, wherein $R_4$ is a $C_1$ to $C_4$ alkyl.

5. A fuel blend as claimed in claim 3, wherein $R_3$ and $R_4$ are each independently selected from $C_1$ or $C_2$ alkyl.

6. A fuel blend as claimed in claim 1, in which the compound of general formula (I) is ethylene glycol diacetate.

7. A fuel blend as claimed in claim 1, wherein the major oxygen-providing component 15 a first compound of formula (I), in which $R_2$ is ethyl, and a second compound of formula (I), in which $R_2$ is methyl.

8. A fuel blend as claimed in claim 7, wherein both the first and second compounds are compounds in which $R_1$ is a $C_1$ to $C_4$ alkyl.

9. A fuel blend as claimed in claim 8, wherein the first compound and the second compound are present in a ratio of from 1:5 to 5:1.

10. A fuel blend as claimed in claim 8, wherein the first compound and the second compound are present in a ratio of from 1:1 to 1:1.5.

11. A fuel blend as claimed in claim 7, wherein the first compound is ethyl acetate and the second compound is methyl acetate.

12. A fuel blend as claimed in claim 1, wherein the major oxygen-providing component comprises a first compound of formula (I), in which $R_2$ is a group of general formula (II), and a second compound of formula (I), in which $R_2$ is a $C_1$ to $C_4$ alkyl.

13. A fuel blend as claimed in claim 12, wherein the first compound is a compound in which $R_1$ is a $C_1$ to $C_4$ alkyl.

14. A fuel blend as claimed in claim 13, wherein the second compound is a compound in which $R_1$ is a $C_1$ to $C_4$ alkyl.

15. A fuel blend as claimed in claim 14, wherein the first compound is ethylene glycol diacetate.

16. A fuel blend as claimed in claim 15, wherein the second compound is selected from methyl acetate, ethyl acetate and mixtures thereof.

17. A fuel blend as claimed in claim 12, wherein the first compound and second compound are present in a ratio of from 0.5:1 to 10:1.

18. A fuel blend as claimed in claim 17, wherein the first compound and second compound are present in a ratio of from 1:1 to 5:1.

19. A fuel blend as claimed in claim 1, further comprising a stabilizer, wherein the compound of general formula (I) and the stabilizer are present in a ratio of from 20:1 to 150:1.

20. A fuel blend as claimed in claim 19, wherein the compound of general formula (I) and the stabilizer are present in a ratio of from 75:1 to 125:1.

21. A fuel blend as claimed in claim 1, further comprising a biocide.

22. A fuel blend as claimed in claim 1, wherein the hydrocarbon-containing fuel component is gasoline and the compound of general formula (I) is present in an amount sufficient to provide an oxygen-content in the fuel blend of 1 to 5 percent by weight.

23. A fuel blend as claimed in claim 1, wherein the hydrocarbon-containing fuel component is diesel and the compound of general formula (I) is present in an amount sufficient to provide an oxygen-content in the fuel blend of 1 to 10 percent by weight.

24. An oxygenating additive for a hydrocarbon-containing fuel comprising:

a first compound having a general formula (III):

$$R_7—(CO)—O—R_6—O—(CO)—R_5 \quad \text{(III)}$$

wherein $R_5$ is selected from lower alkyl, lower alkenyl and lower alkynyl groups;

$R_6$ is selected from lower alkyl; and wherein $R_7$ is selected from lower alkyl, lower alkenyl and lower alkynyl groups; and a second compound having a general formula (IV):

$$R_9—O—(CO)—R_8 \quad \text{(IV)}$$

wherein $R_8$ is selected from hydrogen, lower alkyl, lower alkenyl and lower alkynyl groups; and $R_9$ is selected from lower alkyl, lower alkenyl and lower alkynyl groups.

25. An oxygenating additive as claimed in claim 24, wherein $R_5$ is selected from $C_1$ to $C_4$ alkyl.

26. An oxygenating additive as claimed in claim 25, wherein $R_5$ is methyl.

27. An oxygenating additive as claimed in claim 24, wherein $R_6$ is ethyl.

28. An oxygenating additive as claimed in claim 24, wherein $R_7$ is selected from $C_1$ to $C_4$ alkyl.

29. An oxygenating additive as claimed in claim 28, wherein $R_7$ is methyl.

30. An oxygenating additive as claimed in claim 24, wherein the compound of general formula (III) is ethylene glycol diacetate.

31. An oxygenating additive as claimed in claim 24, wherein $R_8$ is selected from hydrogen, and $C_1$ to $C_4$ alkyl.

32. An oxygenating additive as claimed in claim 31, wherein $R_8$ is methyl.

33. An oxygenating additive as claimed in claim 24, wherein $R_9$ is selected from $C_1$ to $C_4$ alkyl.

34. An oxygenating additive as claimed in claim 33, wherein $R_9$ is selected from methyl and ethyl.

35. An oxygenating additive as claimed in claim 24, wherein the compound of general formula (IV) is selected from methyl acetate and ethyl acetate and mixtures thereof.

36. An oxygenating additive as claimed in claim 24, wherein the compound of general formula (III) and the compound of general formula (IV) are present in a ratio of from 0.5:1 to 5:1.

37. An oxygenating additive as claimed in claim 36, wherein the compound of general formula (III) and the compound of general formula (IV) are present in a ratio of from 1:1 to 2.5:1.

38. An oxygenating additive as claimed in claim 24, further comprising a biocide.

39. An oxygenating additive as claimed in claim 24, further comprising a stabilizer.

40. An oxygenating additive as claimed in claim 39, wherein the stabilizer is selected from alcohols having from 2 to 5 carbon atoms.

41. An oxygenating additive as claimed in claim 40, wherein the stabilizer is ethanol.

42. An oxygenating additive as claimed in claim 39, wherein the ratio of the combined amounts of the compounds of general formulae (III) and (IV) to the stabilizer is from 20:1 to 150:1.

43. An oxygenating additive as claimed in claim 42, wherein the ratio of the combined amounts of the compounds of general formulae (III) and (IV) to the stabilizer is from 75:1 to 125:1.

* * * * *